US010106942B2

(12) United States Patent
Roberge

(10) Patent No.: US 10,106,942 B2
(45) Date of Patent: Oct. 23, 2018

(54) DUAL FUNCTION PUSHER-PULLER PLOW BLADE SYSTEM

(71) Applicant: ATELIER D'USINAGE JULES ROBERGE INC, Saint-Pierre-de-l'Île-d'Orléans (CA)

(72) Inventor: Jules Roberge, Saint-Pierre-de-l'Île-d'Orléans (CA)

(73) Assignee: ATELIER D'USINAGE JULES ROBERGE INC, St-Pierre-de-L'Île -d'Orléans (CA)

( * ) Notice: Subject to any disclaimer, the term of this patent is extended or adjusted under 35 U.S.C. 154(b) by 0 days.

(21) Appl. No.: 15/429,951

(22) Filed: Feb. 10, 2017

(65) Prior Publication Data

US 2017/0226711 A1 Aug. 10, 2017

Related U.S. Application Data

(60) Provisional application No. 62/293,366, filed on Feb. 10, 2016.

(51) Int. Cl.
*E01H 5/06* (2006.01)

(52) U.S. Cl.
CPC ..... *E01H 5/061* (2013.01); *E01H 5/067* (2013.01)

(58) Field of Classification Search
CPC ..... E01H 5/065; E01H 5/066; E01H 5/061; E01H 5/067; E02F 3/8155
USPC ..... 37/274, 281, 273, 231, 280, 196, 219, 37/444, 266; 172/281, 815, 272, 509
See application file for complete search history.

(56) References Cited

U.S. PATENT DOCUMENTS

| | | | | |
|---|---|---|---|---|
| 4,249,323 | A | 2/1981 | Mathis et al. | |
| 4,552,226 | A | 11/1985 | Platter | |
| 5,297,351 | A | 3/1994 | Côté | |
| 5,903,986 | A * | 5/1999 | Parker | E01H 5/066 172/815 |
| 6,240,660 | B1 * | 6/2001 | Dugas | E01H 5/066 37/280 |
| 6,470,604 | B1 | 10/2002 | Foster et al. | |
| 6,581,307 | B1 | 6/2003 | Jones et al. | |

(Continued)

FOREIGN PATENT DOCUMENTS

| | | |
|---|---|---|
| CA | 2240436 | 7/1998 |
| CA | 2371704 A1 | 4/2002 |
| WO | 2006097580 A1 | 9/2006 |

*Primary Examiner* — Robert E Pezzuto
(74) *Attorney, Agent, or Firm* — Norton Rose Fulbright Canada LLP; Alexandre Daoust

(57) ABSTRACT

A plow blade system adapted for mounting to a vehicle, the blade system having a blade orientable transversally to a longitudinal orientation of movement of the vehicle and having two opposite ends, and two side wall assemblies; each side wall assembly having a primary sidewall portion mounted to a corresponding end of the blade, the primary sidewall portion extending longitudinally from the corresponding end in a first longitudinal working direction, a sidewall extension slidably mounted to the primary sidewall portion, and a sidewall actuator mounted between the primary sidewall portion and the sidewall extension and operable to selectively slidingly extend the sidewall extension in a second longitudinal working direction opposite to the first longitudinal working direction and retract the sidewall extension within the primary sidewall portion.

10 Claims, 6 Drawing Sheets

(56) References Cited

U.S. PATENT DOCUMENTS

| | | | | |
|---|---|---|---|---|
| 7,100,311 | B2 * | 9/2006 | Verseef | E01H 5/066 172/815 |
| 7,584,557 | B1 | 9/2009 | Nistler | |
| 7,681,337 | B2 * | 3/2010 | Watson | E01H 5/065 37/274 |
| 8,096,066 | B2 | 1/2012 | Gandolti | |
| 8,191,288 | B2 | 5/2012 | Weagley et al. | |
| 8,850,724 | B2 | 10/2014 | Bloxdorf | |
| 2006/0005435 | A1 | 1/2006 | Gamble, II et al. | |
| 2008/0222927 | A1 | 9/2008 | Frey et al. | |
| 2016/0251825 | A1 | 9/2016 | Landry et al. | |
| 2017/0218597 | A1 | 8/2017 | Holman | |

* cited by examiner

DUAL FUNCTION PUSHER-PULLER PLOW BLADE SYSTEM

CROSS-REFERENCE TO RELATED APPLICATIONS

This patent application claims priority of U.S. Provisional Application Ser. No. 62/293,366, filed on Feb. 10, 2016, the content of which is hereby incorporated by reference.

BACKGROUND

Various forms of vehicle equipment has been developed in the last decades to handle snow, sand, or other bulk materials.

Plow blades are typically mounted to vehicles for moving a material (e.g. snow) from a road or similar surface. These blades are typically curved, e.g. somewhat C-shaped, with the concave face being designed for engagement with the snow. Plow blades can be used obliquely relative to the direction of the vehicle for pushing the material to a side, or transversally to the direction of the vehicle for pushing the material forwardly. Some snowplow blades, commonly referred to as "snow pushers" are specifically designed for pushing snow, and are provided with side walls which protrude forwardly at each transversal end for keeping the snow contained therebetween, against the blade.

These arrangements were satisfactory to a certain degree. However, there always remains room for improvement.

SUMMARY

In accordance with one aspect, there is provided a plow blade system adapted for mounting to a vehicle, the blade system comprising a blade orientable transversally to a longitudinal orientation of movement of the vehicle and having two opposite ends, and two side wall assemblies; each side wall assembly having a primary sidewall portion mounted to a corresponding end of the blade, the primary sidewall portion extending longitudinally from the corresponding end in a first longitudinal working direction, a sidewall extension slidably mounted to the primary sidewall portion, and a sidewall actuator mounted between the primary sidewall portion and the sidewall extension and operable to selectively slidingly extend the sidewall extension in a second longitudinal working direction opposite to said first longitudinal working direction and retract the sidewall extension within the primary sidewall portion.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
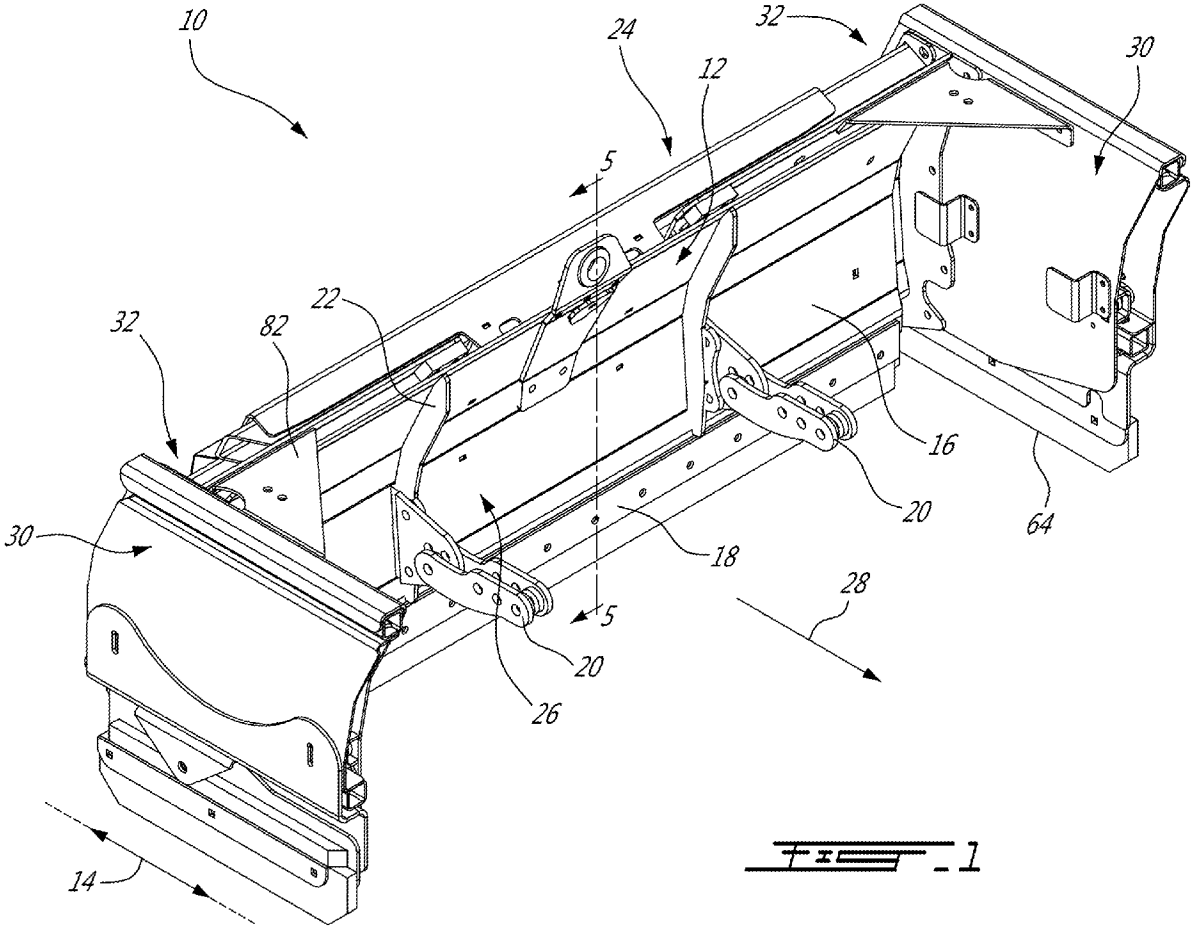
FIG. 1 is an oblique view of a plow blade system configured for operation in a first working direction.

FIG. 1 shows an example of a plow blade system 10 adapted for mounting to a vehicle (not shown). The plow blade system 10 is adapted to push or pull snow with the vehicle, but it will be understood that it can be used to push or pull other materials than snow if desired, and that alternate embodiments can even be specifically adapted to another material than snow.

The plow blade system 10 generally includes a blade 12 which is oriented transversally to a longitudinal orientation 14 of movement of the vehicle during operation. The blade typically has a working portion, sometimes referred to as a mould board 16 and a lower edge 18 designed for engagement with a work surface. Attachments 20 are used to secure the blade 12 to the vehicle, and strengthening ribs 22 can be used between the attachments 20 and the mould board 16. Plow blades 12 are typically slightly bowed (cambered), forming somewhat of a C-shaped cross-section with a convex face 24 and a concave face 26. This curve is made to better adapt the blade 12 to moving the snow with the concave face 26, which tends to prevent, within a certain extent, the snow from escaping by above. The concave face 26 can be said to face a "working direction" 28. Side walls 30 are also provided at each end 32 of the blade 12 and protrude longitudinally from the corresponding ends 32 in the working direction 28. The side walls 30 are used to prevent, to a certain extent, the snow from escaping the blade 12 via the ends 32. In the embodiment shown, the attachments 20 are provided on the concave face 26, which is well adapted for mounting in a manner that the convex face 24 faces away from the vehicle. This configuration is well adapted for "pulling" the snow with the vehicle. It will be understood that in another embodiment, the attachments 20 can be provided on the convex face 24 of the blade 12 instead, for the concave face 26 to face away from the vehicle, for "pushing" the snow with the vehicle.

Accordingly, bowed blades 12 are typically designed either for pushing or for pulling, but to a certain extent, they can also be used to perform the other operation, though typically with a lesser efficiency. Indeed, the convex shape can allow snow to more easily escape above the blade 12, for instance, using a smaller camber, or a flat blade, can alleviate this to a certain extent, but typically affects the efficiency in the other direction. Moreover, side walls 30 are typically directional, and when operating the blade 12 in the opposite direction, the snow can escape around the ends 32. Using side walls 30 which protrude in both directions from the blade 12 would solve this issue, but create another one. Indeed, in some cases, the operator wants to bring the blade 12 in close proximity with a fixed structure such as a building, fence, post or the like, to minimize the amount of snow left between the blade 12 and the structure, and having side walls 30 which protrude in both directions could limit the ability to bring the blade 12 close to such a structure.

Figure 2:
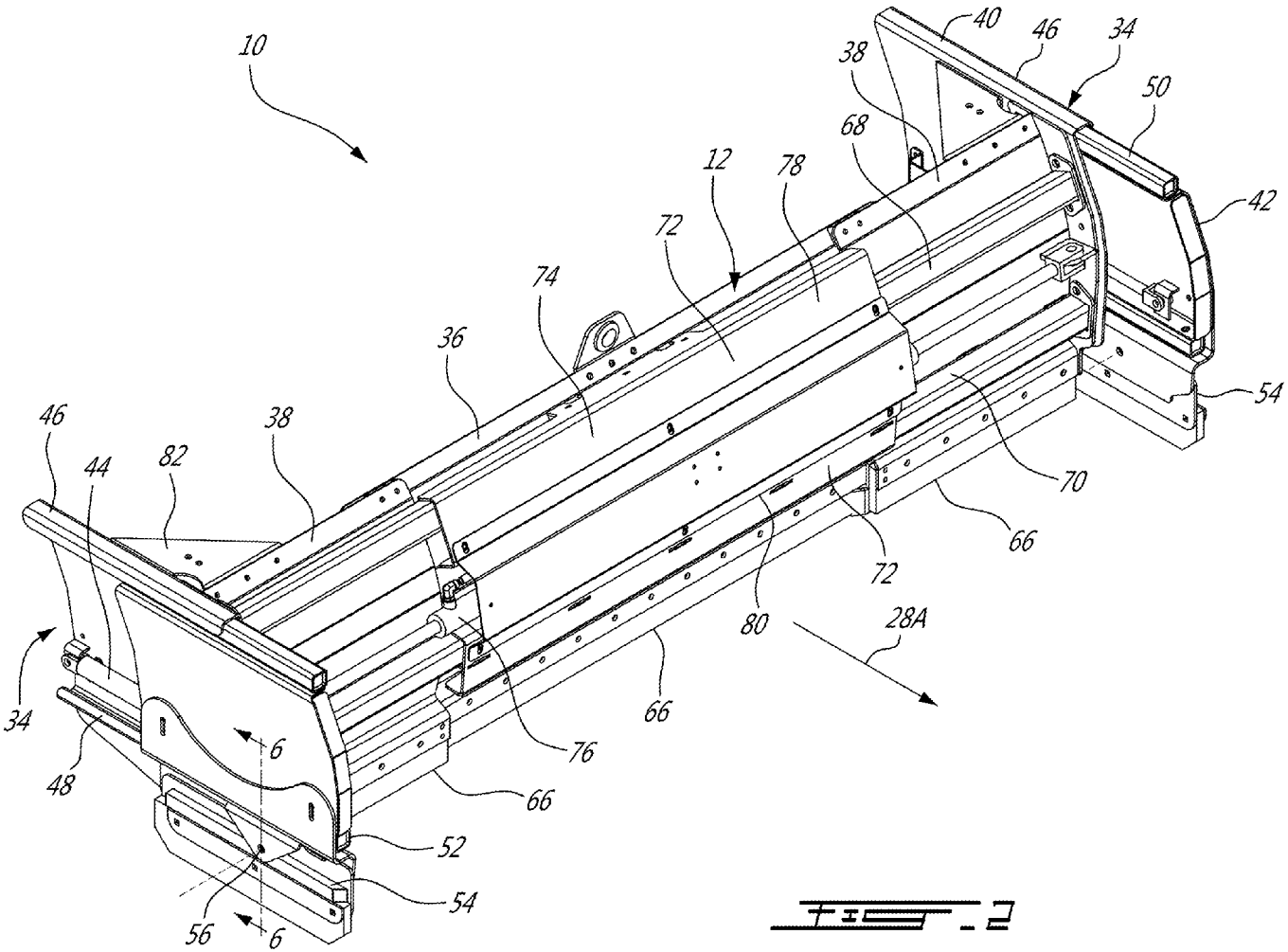
FIG. 2 is another oblique view of the plow blade system of FIG. 1, where the plow blade system is configured for operation in a second, opposite, working direction, and fully transversally extended.
Figure 3:
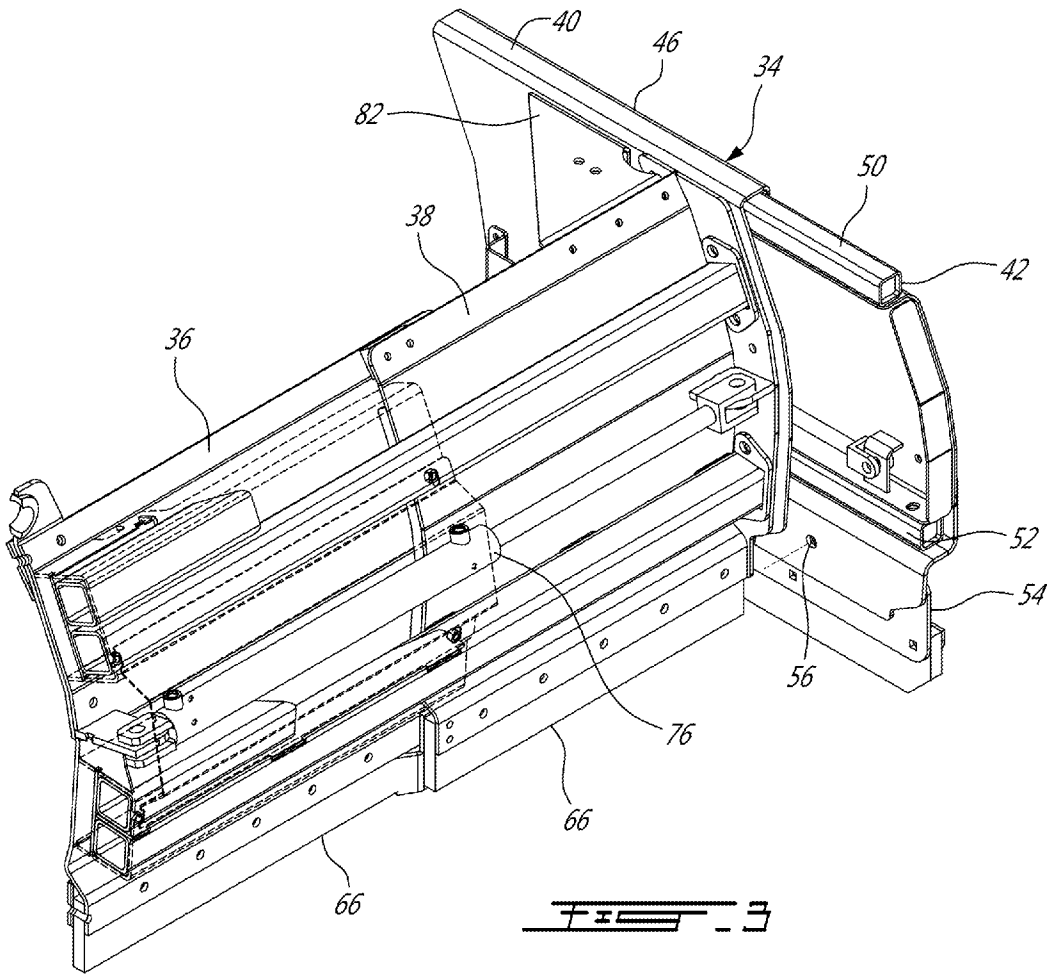
FIG. 3 is a portion of FIG. 2, fragmented and enlarged, with some components removed.

As shown in FIGS. 2 and 3, in this embodiment, the side walls 30 are provided in the form of actuated side wall assemblies 34, the side wall assemblies 34 are operable to temporarily extend on an opposite side of the blade 12, thereby providing a better functionality for pushing (or pulling) in the opposite working direction 28A, and then retract back into the configuration shown in FIG. 1 to resume operation in the main working direction 28.

Moreover, as shown in FIGS. 1-3, in this embodiment the blade 12 is an extensible blade having a central portion 36 and two opposite extensions 38, allowing to change its transversal length during use. This feature, which will be detailed further below, is optional and a non-extensible blade can be used instead of an extensible blade in alternate embodiments.

Figure 4:
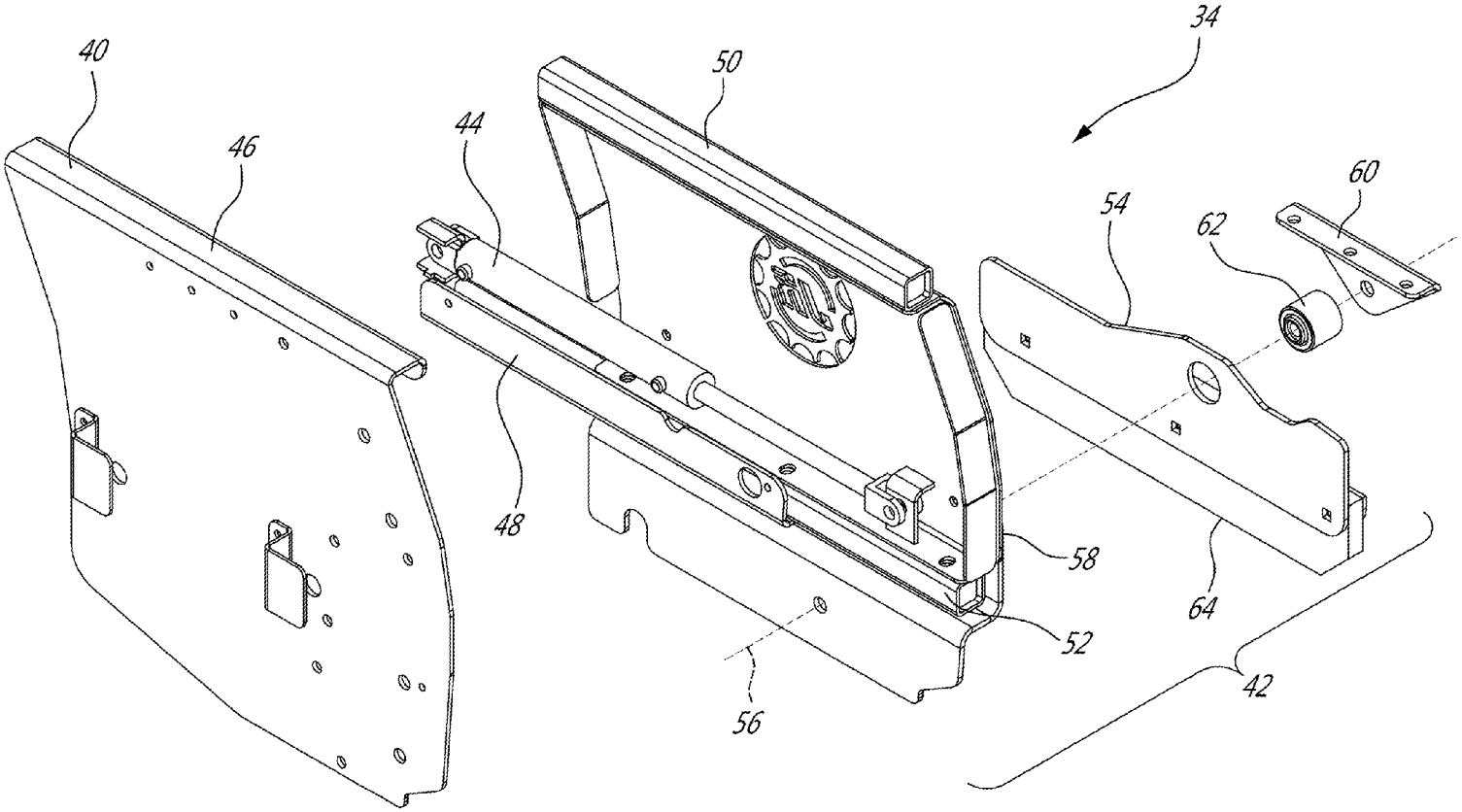
FIG. 4 is an oblique view, exploded, of a left-side side wall assembly of the plow blade system of FIG. 1.
Figure 6:
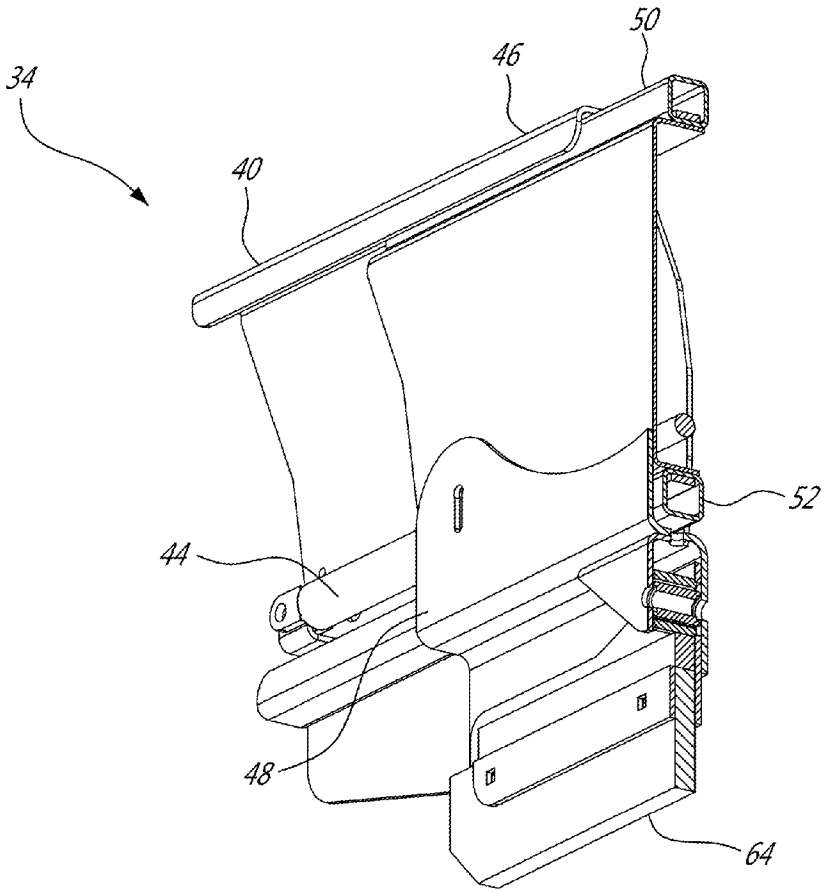
FIG. 6 is a cross-sectional view taken along lines 6-6 of FIG. 2.

The details of the side wall assemblies 34 in this specific embodiment are more clearly illustrated in FIGS. 4 and 6. More specifically, each side wall assembly 34 has a primary side wall 40 which is fixedly mounted to a corresponding end 32 of the blade 12, a side wall extension 42 which is slidingly mounted to the primary side wall 40 in a manner to enable its extension and retraction relative to the primary side wall 40, and a side wall actuator 44 operable to control the extension and retraction. More specifically, in this embodiment, the primary sidewall 40 is provided with an upper guide 46 and a lower guide 48 (shown exploded in FIG. 4 but integral during operation). The side wall extension 42, on the other hand, is provided with an upper sliding member 50 and a lower sliding member 52 which are designed to slidingly and telescopingly engage the corresponding one of the upper guide 46 and lower guide 48, for relative movement in the working direction 28 during operation. In this specific embodiment, the sliding members 50, 52 are provided in the form of square tubes and the guides 46, 48 are provided in the form of U-shaped channels, and the side wall actuator 44 is provided in the form of an extendible cylinder provided vertically between the two square tubes, although it will be understood that the specifics can vary in alternate embodiments.

In this specific embodiment, the sidewall assemblies 34 further include edge assemblies 54 which are pivotally mounted to the sidewall extensions 42 for pivoting around a transversally-oriented pivot axis 56. More specifically, the edge assembly 54 is pivotally mounted to a frame 58 of the side wall extension 42 (provided here in the form of a folded sheet metal component), via a bracket 62 and a bearing 64. The side edge assembly 54 includes a longitudinally-oriented side edge 64 which is adapted to engage a work surface. The side edge 64 is made of steel and firmly secured to the side edge assembly 54 in this embodiment but alternate embodiments are possible such as side edges made of a resilient material or connected via resilient components.

Figure 5:
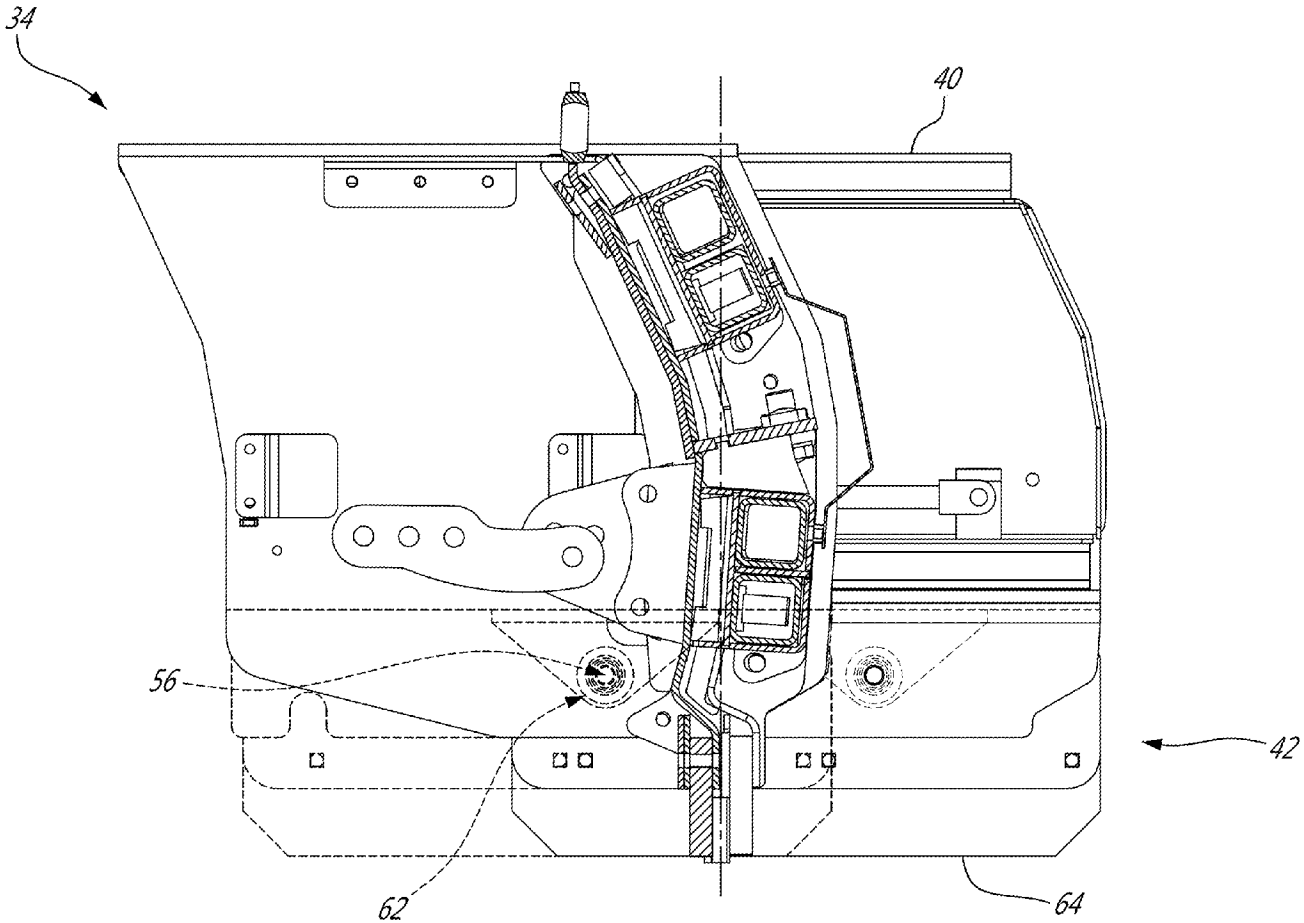
FIG. 5 is a cross-sectional view taken along lines 5-5 of FIG. 1.

Referring to FIG. 5, it will be seen that in this embodiment, the transversal pivot axis 56 (coinciding here with the bearing 62) is moved with the side wall extensions 42 when the side wall extensions 42 are extended or retracted. More specifically, the transversal pivot axis 56 is moved to the working side of the blade 12 in both configurations. It is believed that this is not essential, but can provide smooth operation of the plow blade system 10 in both working directions compared to an embodiment where the sidewall edge 64 would be pivotally mounted to the primary sidewall 40 rather than to the sidewall extension 42, or non-pivotally-mounted, for instance.

In an alternate embodiment, the sidewalls 34 are not extendible, but a pivotally mounted sidewall edge 64 is used, with a transversal pivot axis 56 being on the working side of the blade 12.

Referring back to FIGS. 2 and 3, the optional extensibility of the blade 12 in this embodiment will be explained. The blade 12 has a central portion 36 and two opposite blade extensions 38, all three of which have downwardly extending blade edges 66 for engagement with a work surface. Each blade extension 38 has an upper telescoping member 68 and a lower telescoping member 70 which is slidingly engaged with a corresponding female feature 72 in the central portion 36. In this embodiment, the corresponding female feature 72 is provided by a corresponding guide cap 74 which is secured to the central portion 36 of the blade 12. Moreover, each blade extension 38 has a corresponding blade extension actuator 76 provided between the central portion 36 and the corresponding blade extension 38, and operable to extend or retract the corresponding blade extension 38 (see transition from FIG. 1 to FIG. 2). In this embodiment, the telescoping members 68, 70 are square tubes, both upper square tubes are received within an upper guide cap 78, and both lower square tubes are received within a lower guide cap 80. A separator is provided between the two lower square tubes as part of the lower guide cap 80. The primary sidewall portions 40 are secured to the corresponding blade extensions via brackets 82 provided at the upper edge, for additional rigidity.

As can be understood, the examples described above and illustrated are intended to be exemplary only. For instance, in the embodiment illustrated, the blade is bowed and the attachments to the vehicle are provided on the concave side, a configuration in which the main working direction is "pulling". It will be understood that in an alternate embodiment, the attachments to the vehicle can be provided on the convex side of the blade in a configuration where the main working direction is "pushing" (the side wall extensions being extendible for working in an auxiliary "pulling" working direction). Alternately, the blade can be straight rather than bowed. The scope is indicated by the appended claims.

What is claimed is:

1. A plow blade system adapted for mounting to a vehicle, the plow blade system comprising a blade orientable transversally to a longitudinal orientation of movement of the vehicle and having two opposite ends, and two side wall assemblies; each side wall assembly having a primary sidewall portion mounted to a corresponding end of the blade, the primary sidewall portion extending longitudinally from the corresponding end in a first longitudinal working direction, a sidewall extension slidably mounted to the primary sidewall portion, and a sidewall actuator mounted between the primary sidewall portion and the sidewall extension and operable to selectively i) extend the sidewall extension in a second longitudinal working direction, opposite to said first longitudinal working direction, and ii) retract the sidewall extension back to its initial position.

2. The plow blade system of claim 1 wherein the blade has a blade edge protruding downwardly therefrom for engagement with a work surface, and the sidewall extensions each have a sidewall edge protruding downwardly therefrom for engagement with the work surface.

3. The plow blade system of claim 2 wherein the sidewall edges are each provided as part of a sidewall edge assembly, the sidewall edge assembly being pivotally mounted to the rest of the corresponding sidewall extension for pivoting around a transversal pivot axis.

4. The plow blade system of claim 3 wherein the transversal pivot axis is positioned on a first working side of the blade when the sidewall extensions are retracted for operating in the first longitudinal working direction, and positioned on the second working side of the blade when the sidewall extensions are extended for operating in the second longitudinal working direction.

5. The plow blade system of claim 2 wherein blade edges and the sidewall edges are made of steel.

6. The plow blade system of claim 1 wherein each sidewall extension has an upper telescoping member and a lower telescoping member each being slidingly engaged with a corresponding guiding member provided integral to the corresponding primary sidewall portion.

7. The plow blade system of claim 6 wherein the telescoping members are square tubes.

8. The plow blade system of claim 1 wherein the blade is an extensible blade having a central portion, and two opposite blade extensions, each blade extension being slidably mounted to the central portion on a corresponding transversal side thereof, and two blade actuators, each blade actuator being mounted between the central portion and a corresponding one of the blade extensions and operable to selectively extend and retract the corresponding blade extension relative to the central portion.

9. The plow blade system of claim 8 wherein each blade extension has an upper telescoping member and a lower telescoping member slidingly engaged with corresponding guiding members of the central portion.

10. The plow blade system of claim 9 wherein the telescoping members are square tubes.

* * * * *